US006564489B1

(12) United States Patent
Bader

(10) Patent No.: US 6,564,489 B1
(45) Date of Patent: May 20, 2003

(54) COLLAPSIBLE SUPPORT FRAME FOR A SIGN

(76) Inventor: Winston Bader, 374 S. Prospectors Rd. #121, Diamond Bar, CA (US) 91765

( * ) Notice: Subject to any disclaimer, the term of this patent is extended or adjusted under 35 U.S.C. 154(b) by 0 days.

(21) Appl. No.: 10/081,814

(22) Filed: Feb. 22, 2002

(51) Int. Cl.[7] ..... G09F 15/00
(52) U.S. Cl. ..... 40/610; 116/63 P
(58) Field of Search ..... 40/610; 116/63 P

(56) References Cited

U.S. PATENT DOCUMENTS 4,103,445 A * 8/1978 Smith et al. ..... 40/610
4,375,134 A * 3/1983 Sheetz ..... 40/610
4,407,505 A * 10/1983 Kendziorski ..... 116/173

* cited by examiner

*Primary Examiner*—Cassandra Davis
(74) *Attorney, Agent, or Firm*—Goldstein & Lavas, P.C.

(57) ABSTRACT

A collapsible support frame for a sign, having a base, a main hollow vertical tube, and a support assembly. The support assembly consists of a pair of vertical supports, a lower horizontal support, and an upper horizontal support, which together define a rectangular frame. When assembled, the support assembly holds the sign in place. The base is attached to the bottom of the tube and lends stability to the support frame. The frame may be collapsed, for easy storage, with the support assembly fitting fully within the hollow vertical tube.

11 Claims, 4 Drawing Sheets

SALE
10
12
14
14C
16
16B
16T
17
18
18B
18T
20
20A
21
21A
28
32
34
36
40

COLLAPSIBLE SUPPORT FRAME FOR A SIGN

BACKGROUND OF THE INVENTION

The invention relates to a collapsible support frame for a sign. In particular, the invention is a support frame which is capable of supporting a sign when deployed and collapses into a compact lightweight structure for easy transport and storage.

In many fields and businesses, it is necessary to advertise services or specials on signs. Especially in the real estate business, these signs are typically moved from location to location in order to advertise a property for sale. The signs are often placed in front of the property to allow for greater visibility by passersby. These signs are heavy and cumbersome, and do not allow for easy transport. New signs are needed for different types of properties, as well as for different agents. Thus, it is often necessary for an agent to carry a plurality of signs with himself/herself. This practice requires a great deal of space and a considerable manpower.

Besides real estate agents, many businesses also use signs to advertise. These signs convey various information to prospective consumers, ranging from daily specials to information about the company and its goods or services. Such signs are necessary to draw customers into the store. Because of the lack of availability of a suitable sign support device, many stores are forced to simply place signs and notices in their windows. Besides limited the amount of exposure, this practice also creates a messy appearance for the storefront.

Thus, there exists a need for a support frame that may be used to display various sized signs in any location. Such a frame should be lightweight and easily transported. When collapsed, the support frame is compact and may be fit into a suitcase for convenient storage. The frame should also be adjustable to fit any size sign.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved collapsible support frame for a sign. As such, the general purpose of the present invention, which will be described subsequently in greater detail, is to provide a new and improved collapsible support frame for a sign which has all the advantages of the prior art and none of the disadvantages.

To attain this, the present invention essentially comprises a collapsible support frame for a sign, having a base, a main hollow vertical tube, and a support assembly. The support assembly consists of a pair of vertical supports, a lower horizontal support, and an upper horizontal support, iL which together define a rectangular frame. When assembled, the support assembly holds the sign in place. The base is attached to the bottom of the tube and lends stability to the support frame. The frame may be collapsed, for easy storage, with the support assembly fitting fully within the hollow vertical tube.

It is an object of the invention to produce a collapsible support frame for a sign that may be easily transported and stored when not in use. Accordingly, the support frame may be collapsed into a plurality of supports, said supports being stored in the main tube of the frame.

It is a further object of the invention to produce a collapsible support frame for a sign that may accommodate any size sign. Accordingly, the support frame may be adjusted to hold a smaller or larger sign.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

Figures 1, 2:
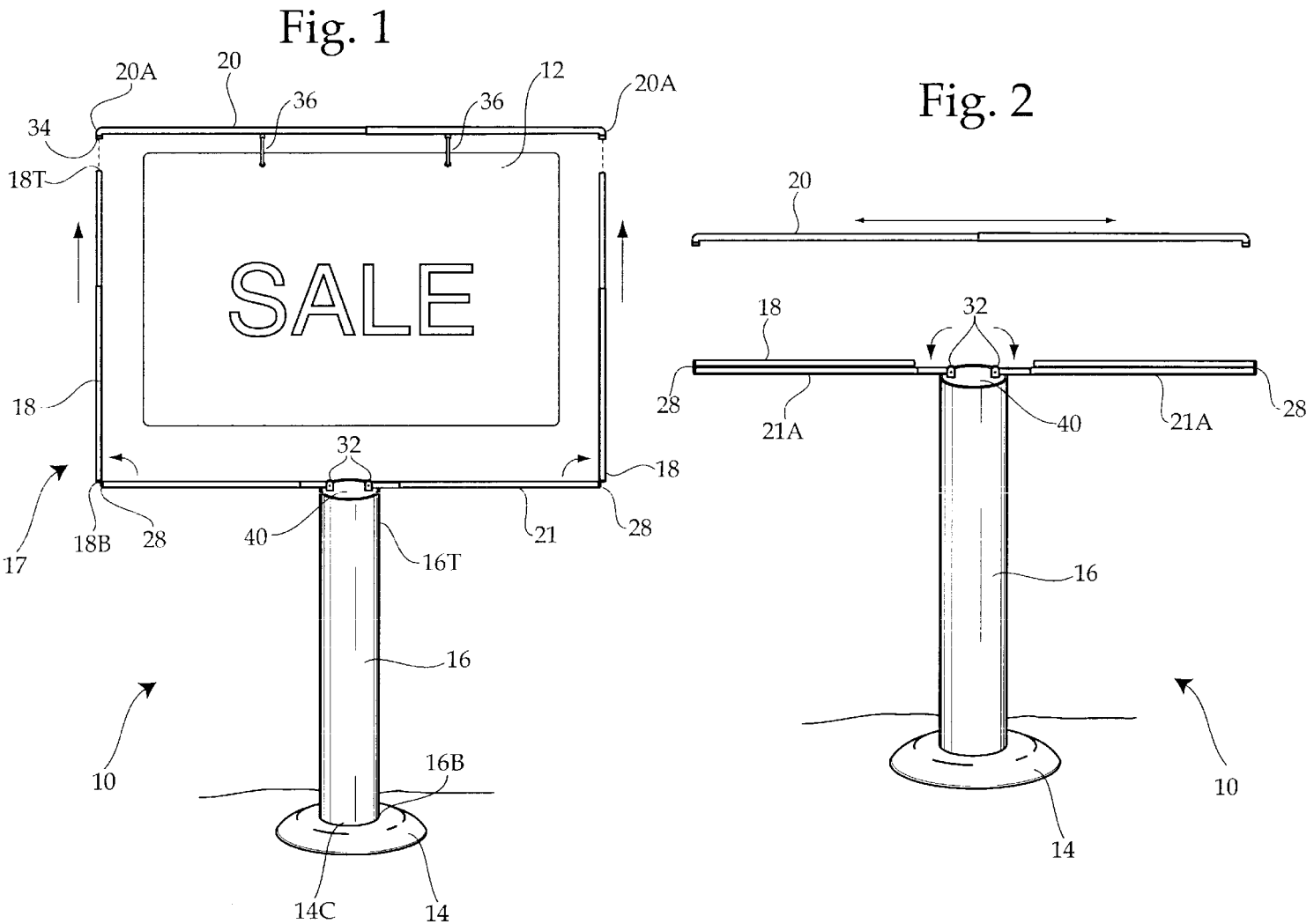
FIG. 1 is a front elevational view of the collapsible support frame for a sign in the assembled position.
FIG. 2 is a front elevational view of the collapsible support frame in a partially assembled state.

| REFERENCE NUMERALS | |
|---|---|
| 10 | collapsible support frame |
| 12 | sign |
| 14 | base |
| 14C | center of base |
| 16 | main hollow vertical tube |
| 17 | support assembly |
| 16B | bottom end of main hollow vertical tube |
| 16T | top end of main hollow vertical tube |
| 18 | pair of adjustable vertical supports |
| 18T | top end of vertical supports |
| 18B | bottom end of vertical supports |
| 20 | upper horizontal support |
| 20A | opposite ends of upper horizontal support |
| 21 | lower horizontal support |
| 21A | two halves of lower horizontal support |
| 22 | threaded segment of main vertical tube |
| 24 | bore in base |
| 26 | anchor |
| 28 | joint |
| 32 | pair of hinges |
| 34 | neck |
| 36 | cables |
| 38 | cap |
| 40 | flat plate of cap |
| 42 | handle |
| 44 | case |
| 46 | indentations in case |

DETAILED DESCRIPTION OF THE PREFERRED EMBODIMENTS

FIG. 1 illustrates a collapsible support frame 10 for a sign 12, essentially comprising a base 14, a main vertical tube 16, and a support assembly 17. The sign 12 is selectively positioned within the support assembly 17, and attached thereto for display.

Figure 3:
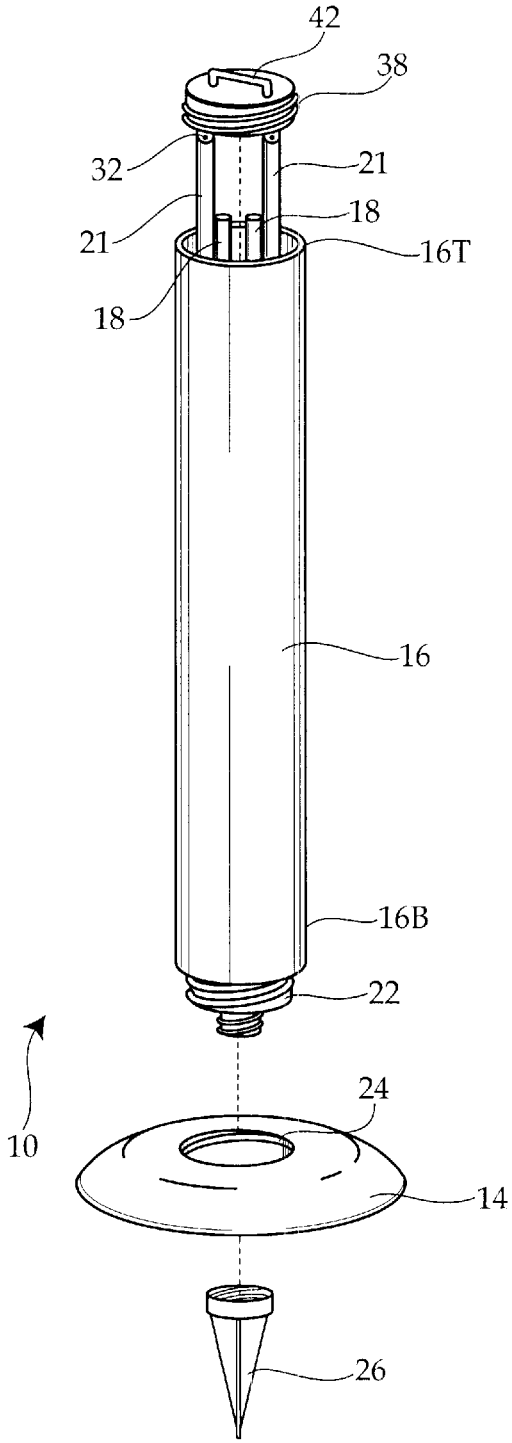
FIG. 3 is a perspective view of the collapsible support frame in a partially collapsed state.

The main vertical tube 16 has a bottom end 16B, a top end 16T, and a hollow interior. A cap 38 is mateable with the top end 16T of the tube 16. The cap 38 has two sides, wherein one side of the cap 38 is a flat plate 40 connected to the support assembly 17, and a handle 42 is positioned on the opposite side of the cap 38, as seen in FIG. 3. When the support frame 10 is collapsed, the cap 38 is positioned within the top end 16T of the tube 16 so that the handle 42 is oriented upward, outside of the tube 16. When assembled, the handle 42 is positioned inside the tube 16, with the flat plate 40 and the support assembly 17 outside of the tube 16, such that the support assembly 17 attached thereto extends upward therefrom.

Figure 4:
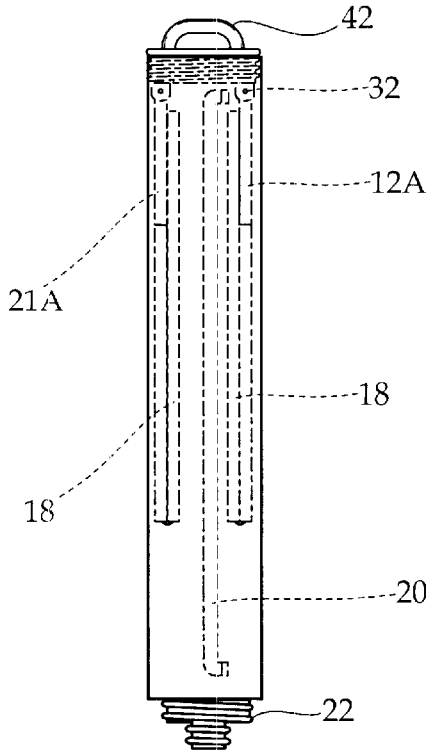
FIG. 4 is a front elevational view of the collapsible support frame in a collapsed state, with the support assembly shown in broken lines inside the tube.

The base 14 is positioned at the bottom end 16B of the main tube 16. The base 14 is weighted in order to lend stability to the support frame 10, and to prevent said frame 10 from tipping over. As seen in FIG. 4, the bottom end 16B of the tube 16 has a threaded segment 22 extending downward therefrom, said segment 22 mateable with a bore 24 extending through a center 14C of the base 14. When mated with the threaded segment 22, the base 14 is secured in place at the bottom end 16B of the tube 16. An anchor 26 may be attached to the threaded segment 22 under the base 14. The anchor 26 is pointed so that it can penetrate a ground surface, in order to anchor the support frame 10 on a soft surface, particularly dirt or grass.

The support assembly 17 extends upward from the top end 16T of the tube 16, has a pair of adjustable vertical supports 18, an upper adjustable horizontal support 20, and a lower adjustable horizontal support 21. The lower horizontal support 21 comprises two halves 21A. Each vertical support 18 has a hollow top end 18T, and a bottom end 18B. The bottom ends 18B of the vertical supports 18 are attached at either end of the lower horizontal support 21, and selectively extend upward therefrom at right angles. Joints 28 are situated between the bottom ends 18B of the vertical supports 18 and the lower horizontal support 21, and allow the vertical supports 18 to pivot thereabout and to collapse parallel to the lower horizontal support 21. A pair of hinges 32 are located in the center of the lower horizontal support 21, thus separating said support 21 into the two halves 21A, and are attached to the flat plate 40 of the cap 38. These hinges 32 allow the halves 21A of the lower horizontal support 21 to selectively pivot upward so that they extend parallel to each other to facilitate compact storage, or extend away from each other when the support assembly 17 is assembled.

The upper horizontal adjustable support 20 has two opposite ends 20A, with a neck 34 making a ninety degree turn and extending downward from each end 20A. The necks 34 are sized to mate with the hollow top ends 18T of the vertical supports 18. A plurality of cables 36 are attached along the length of the upper horizontal support 20 and extend downward therefrom. The cables 36 are provided for attaching to the sign 12 for supporting the sign 12 in place during display. All of the supports 18, 20, 21 are telescoping, thus enabling the support assembly 17 to be adjusted according to the size of the sign 12 to be held.

The support assembly 17 is collapsible for storage within the interior of the tube 16. The necks 34 at each end 20A of the upper horizontal support 20 are detached from the top ends 18T of the vertical supports 18. The vertical supports 18 are then shortened, and folded downward at the joints 28 between said vertical supports 18 and the lower horizontal support 21, so that they extend parallel to each other, as illustrated in FIG. 2. The halves 21A of the lower horizontal member 21 are then pivoted upward into a vertical position along the hinges 32 attached to the cap plate 40. The cap 38 is unscrewed from the top end 16T of the tube 16, and inverted so that the plate 40 is facing downward and the handle 42 is positioned upward. The support assembly 17 is then fitted within the interior of the tube 16, as illustrated in FIG. 3. Once completely in place inside the tube 16, the cap 38 is screwed into the top end 16T of the tube 16, thereby containing the support assembly 17 inside said tube 16, as illustrated in FIG. 4.

Figure 5:
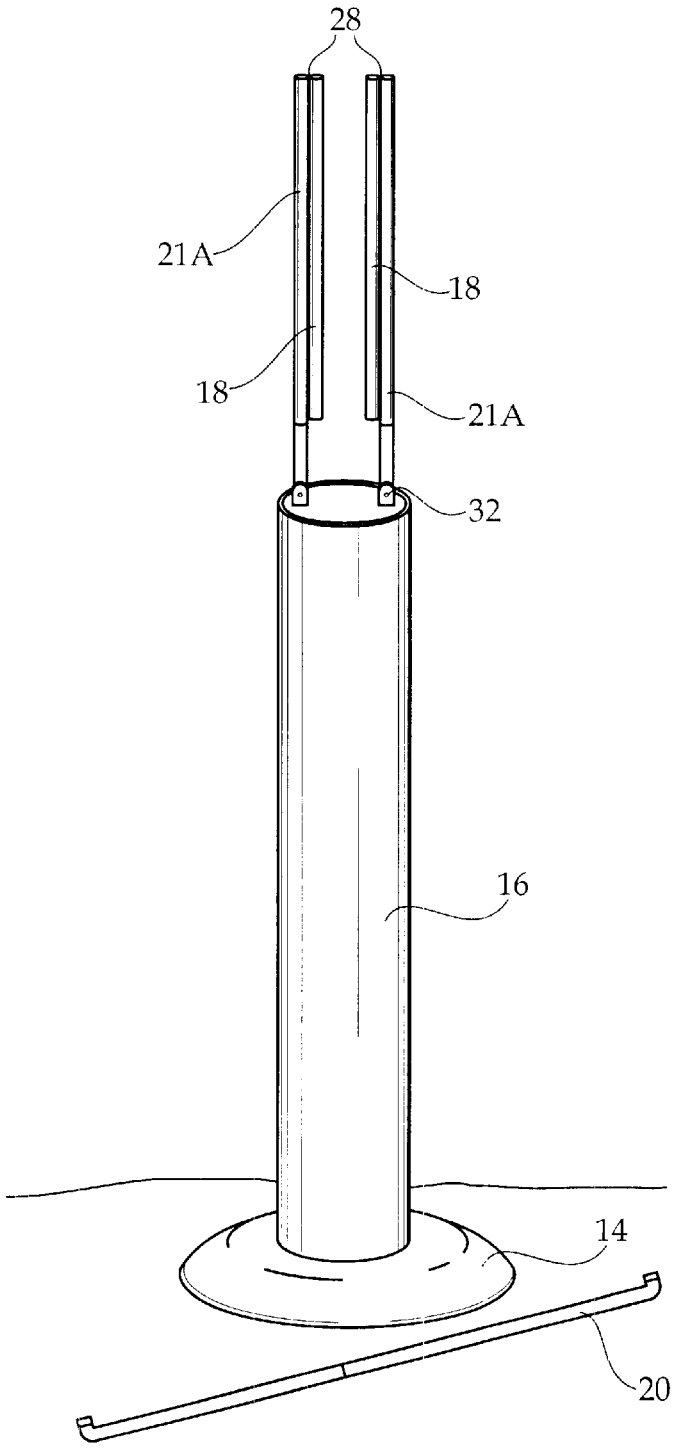
FIG. 5 is a perspective view of the collapsible support frame in a partially assembled state.

To utilize the support frame 10, the support assembly 17 must first be removed from the interior of the tube 16. Accordingly, the cap 38 is unscrewed from the top end 16 of the tube 16, and the collapsed support assembly 17 is inverted upward. The cap 38 is then threaded into the top end 16 of the tube 16, with the plate 40 facing upward, as illustrated in FIG. 5. The supports 18, 20, 21 may then be unfolded and sized as necessary according to the sign to be displayed. The bottom end 16B of the tube 16 is then mated with the base 14 and the anchor 26, if necessary.

Figure 6:
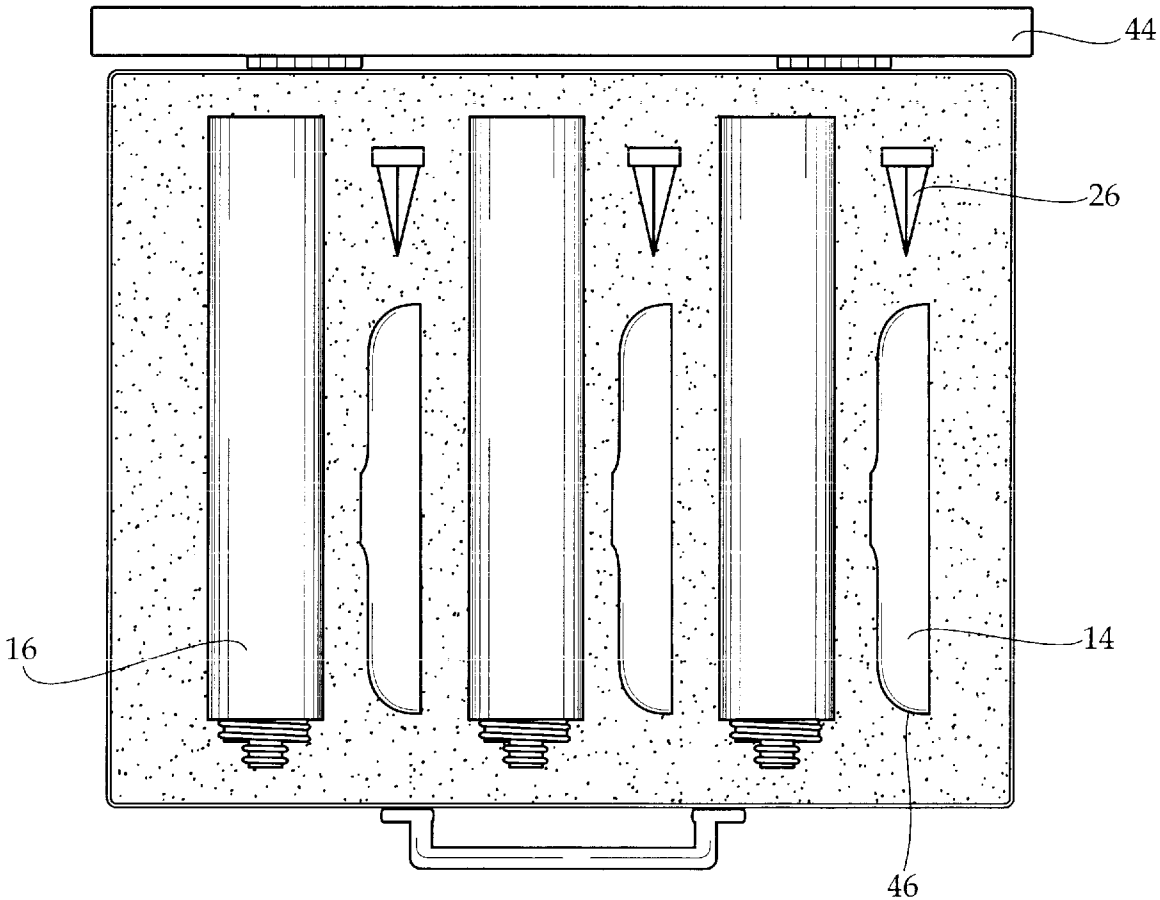
FIG. 6 is a perspective view of a plurality of collapsible support frames in a case.

A case 44 may also be provided to carry a plurality of support frames 10, as illustrated in FIG. 6. The case 44 has presized indentations 46 to accommodate the tube 16, the base 14, and the anchor 26.

In conclusion, herein is presented a collapsible support frame for a sign. The invention is illustrated by example in the drawing figures, and throughout the written description. It should be understood that numerous variations are possible, while adhering to the inventive concept. Such variations are contemplated as being a part of the present invention.

What is claimed is:

1. A collapsible support frame for a sign, comprising:

a main vertical tube, having a top end, a bottom end, and a hollow interior;

a cap selectively mounted in the top end of the tube, said cap having two sides, wherein the first side is a flat plate and the opposite side has a handle;

a support assembly, the assembly attached to the flat plate of the cap in the top end of the main tube, comprising vertical supports, an upper horizontal support, and a lower horizontal support, for selectively creating a rectangular frame for holding the sign, and for selectively all extending parallel so that the cap can be inverted and said vertical supports, upper horizontal support, and lower horizontal support can fit within the tube for storage; and a base having a center bore, the base attached to the bottom end of the main tube.

2. The collapsible support frame for the sign as recited in claim 1, wherein the vertical supports of the support assembly each have a top end and a bottom end, the upper horizontal support has two ends and a neck extending downward from each end, said necks mateable with the top ends of the vertical supports, the lower horizontal support has two halves which are each connected to the flat plate of the cap and each have an end opposite therefrom, and the support assembly further including joints connecting one of the lower horizontal support ends with the bottom ends of one of the vertical supports, said joints allowing the vertical supports to selectively pivot, and wherein the sign is positionable between the vertical and horizontal supports.

3. The collapsible support frame for the sign as recited in claim 2, further comprising a plurality of cables attached to the upper horizontal support and extending downward therefrom for supporting a sign within the support assembly.

4. The collapsible support frame for the sign as recited in claim 3, wherein the two halves of the lower horizontal support of the support assembly are attached to the flat plate of the cap by a pair of hinges, said hinges allowing the two halves of the lower support to selectively pivot upward parallel to each other for storage, or extend fully away from each other for use.

5. The collapsible support frame for the sign as recited in claim 4, wherein a threaded segment is positioned at the bottom end of the tube, said segment mateable with the center bore of the base, thereby securing the base to the main vertical tube.

6. The collapsible support frame for the sign as recited in claim 5, further comprising an anchor, said anchor mateable with the threaded segment of the main tube, wherein the anchor is attached to the tube beneath the base and allows the support frame to be anchored into a soft ground surface.

7. The collapsible support frame for the sign as recited in claim 6, wherein each of the vertical and horizontal supports of the support assembly is telescoping to allow the size of the support assembly to be adjusted according to the size of the sign to be displayed.

8. The collapsible support frame for the sign as recited in claim 7, wherein the base is weighted.

9. The collapsible support frame for the sign as recited in claim 8, further comprising a carrying case having presized indentations for storing a plurality of collapsed support frames, including the tube, base, and anchor.

10. A method of displaying a sign in a support frame, the support frame comprising a main tube, a support assembly, and a base, the main tube having a top end, a bottom end, a hollow interior, a threaded segment at the bottom end, and a cap mated with the top end, said cap having a flat plate on one side and a handle on the opposite side, the support assembly comprising a pair of hollow vertical supports each having a top end and a bottom end, an upper horizontal support having two ends, a neck extending downward from each end, and a plurality of cables extending downward from the support, and a lower horizontal support, wherein the vertical and horizontal supports are telescoping, comprising the steps of:

unscrewing the cap from the top end of the tube;

removing the support assembly from the tube by removing the cap from the tube;

reattaching the cap to the top end of the tube with the handle oriented downward on the inside of the tube and the flat plate oriented upward on the outside;

unfolding the support assembly;

adjusting the lengths of the vertical and horizontal supports according to the size of the sign to be displayed;

mating the neck portions of the upper horizontal support with the top ends of the vertical supports;

supporting the sign by attaching the cables of the upper horizontal support to the sign; and mating the base with the threaded segment at the bottom end of the tube.

11. A method of displaying a sign in a support frame, using a support assembly having a pair of vertical supports, each having a bottom end, a lower horizontal support having two halves and a pair of ends, the support assembly also having a cap with a flat plate, a pair of joints situated between the bottom ends of the vertical supports and the ends of the lower horizontal support, a pair of hinges positioned at a middle portion of the lower horizontal support between the halves of said lower horizontal supports, said hinges attached to the flat plate of the cap, and wherein the lower horizontal support has two halves each connected to the flat plate of the cap, comprising the steps of:

pivoting the two halves of the lower horizontal support downward about the hinges, so that said halves extend directly away from each other; and pivoting the pair of vertical supports upward about the joints, thus creating a right angle with the lower horizontal support halves.

* * * * *